United States Patent [19]

Monroe

[11] 4,345,877

[45] Aug. 24, 1982

[54] AXIAL FLOW FANS AND BLADES THEREFOR

[75] Inventor: Robert C. Monroe, Houston, Tex.

[73] Assignee: Hudson Products Corporation, Houston, Tex.

[21] Appl. No.: 136,511

[22] Filed: Apr. 4, 1980

[51] Int. Cl.[3] ..... F04B 29/34

[52] U.S. Cl. ..... 416/239; 416/245 R

[58] Field of Search ..... 416/226, 239, 241 A, 416/245 R, 245 C

[56] References Cited

U.S. PATENT DOCUMENTS

| | | | |
|---|---|---|---|
| 2,568,230 | 9/1951 | Gluhareff | 416/226 X |
| 2,589,786 | 3/1952 | Engel et al. | 416/241 A |
| 2,908,335 | 10/1959 | Petty | 416/220 A |
| 2,951,541 | 9/1960 | Hinds | 416/241 A |
| 3,799,701 | 3/1974 | Rothman | 416/241 A X |
| 4,110,056 | 8/1978 | Stevenson | 416/239 X |

FOREIGN PATENT DOCUMENTS

| | | | |
|---|---|---|---|
| 846035 | 8/1952 | Fed. Rep. of Germany | 416/245 |
| 421165 | 5/1947 | Italy | 416/245 |

*Primary Examiner*—Leonard E. Smith

*Attorney, Agent, or Firm*—Vaden, Eickenroht, Thompson, Bednar & Jamison

[57] ABSTRACT

There is disclosed an axial flow fan having blades which are made up of metallic inner portions attached to the hub of the fan, and outer plastic portions whose inner ends are secured to the outer ends of the metallic portion. The plastic portions are hollow and have an exterior surface of air foil cross section, and seal discs on one side of the hub extend outwardly therefrom to approximately the intersection of the metallic and plastic portions.

11 Claims, 7 Drawing Figures

Fig. 4
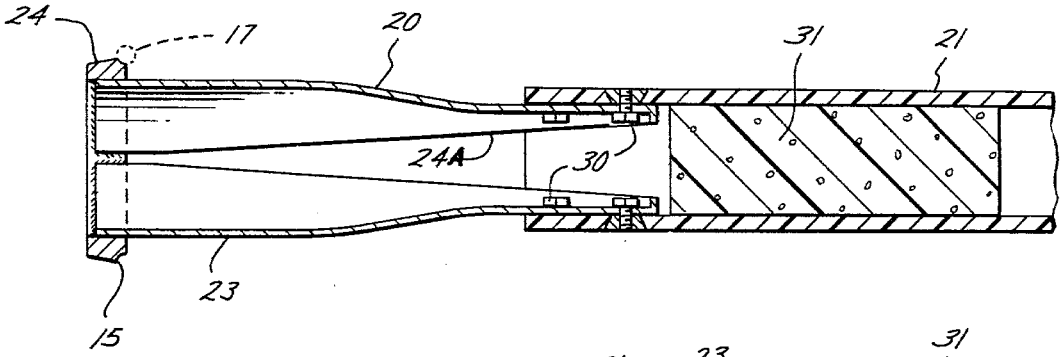
Fig. 5
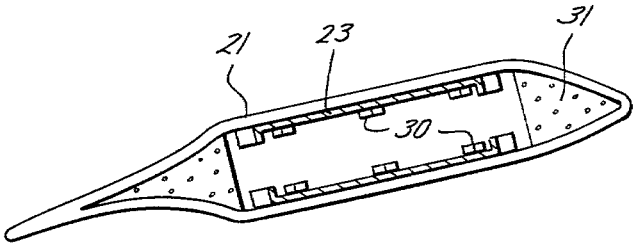
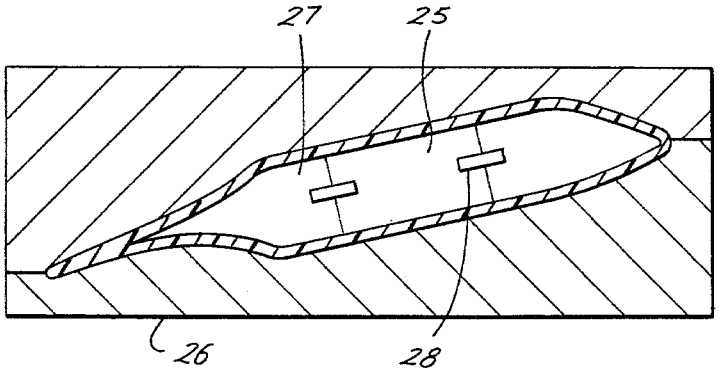
Fig. 6
Fig. 7
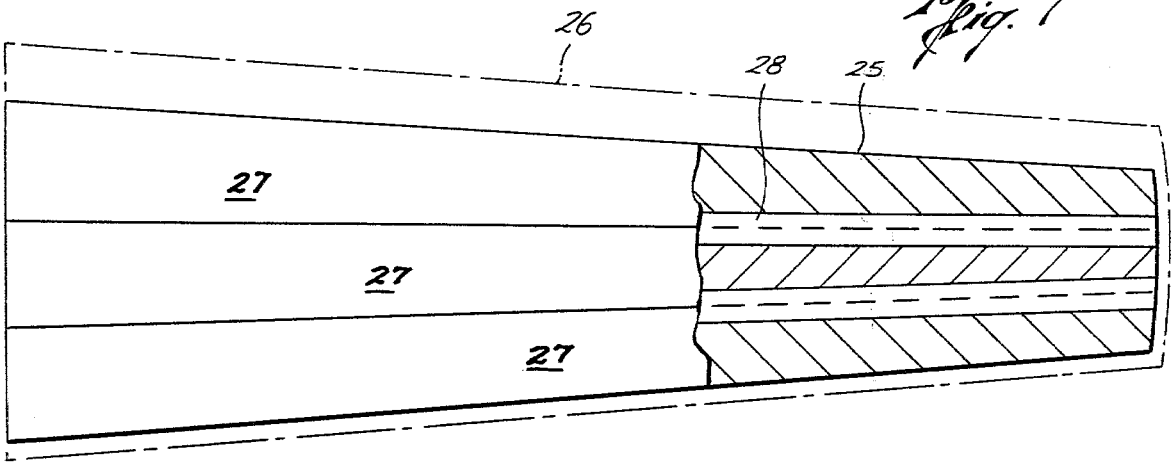

AXIAL FLOW FANS AND BLADES THEREFOR

This invention relates to large, industrial-type axial flow fans; and, more particularly, to improvements in fans of this type wherein seal discs cover non-working areas on the inner portion of the blades intermediate their attachment to the fan hub and air foil-shaped working areas on the outer portions thereof. In one of its aspects, this invention relates to improvements in hollow blades for use in such fans.

The "swirl" effect of torque upon the axial exit air vectors cause negative air flow through such a fan which, if not prevented by the seal disc, would substantially lessen its efficiency. This is especially true when the fan may be 10 feet or more in diameter, as is often the case when used in and around industrial locations. In order to overcome this problem, the disc usually extends out over approximately 30%–50% of the radial extent of the blades.

In order to reduce the weight and cost of such a fan, its blades are preferably hollow. Also, since the inner portions of the blades covered by the disc perform no useful work, the size and weight of each such blade is minimized by providing a neck at its inner end which is attached to the hub. A transition area extends laterally outwardly from the neck to connect to the wide, inner end of the working, air foil portion.

It has been proposed to make blades for fans of this type of either metal or plastic reinforced with fiberglass. Although metal blades may be cheaper to fabricate, it may be preferred, and possibly may be the only alternative, when they are to have intricate air foil shapes, to mold the blades of plastic. As shown, for example, in U.S. Pat. No. 2,945,262, in a typical molding process, resin is applied to reinforcement contained within a space between a rigid outer mold member and a bag forming an inner mold member, and the bag is pressurized to impregnate the reinforcement with the resin.

A molding process of this type is both time consuming and expensive. Also, difficulty is often encountered in obtaining even distribution of resin throughout the reinforcement at the sharp corners of the blade. As a result, the blade may fail due to an excess of resin at the intersection of its neck and transition area.

The primary object of the present invention is to provide an axial flow fan of the type described having blades whose working areas are molded of reinforced plastic, but which are less susceptible to breakage and yet less expensive to manufacture than blades fabricated in accordance with the procedures above described.

Another object is to provide such a fan having blades which are of composite construction including metallic as well as plastic portions which are secured to one another in a simple and inexpensive manner.

These and other objects are accomplished, in accordance with the illustrated embodiment of the invention, by means of an axial flow fan of the type described wherein each of the blades comprises a metallic portion having a neck which is attached to the hub, and a reinforced plastic portion which has an exterior air foil cross section and an inner end which is secured to the outer end of the metallic portion, and the outer periphery of the seal disc on one side of the hub extends outwardly therefrom to approximately the inner ends of the plastic portions of the blades. Thus, while the working areas of the blades may be molded to intricate air foil cross sections, the non-working areas of the blades may be fabricated of metal by an inexpensive process requiring no smooth finishes or intricate shapes. As will also be apparent, the securement of the ends of the plastic and metallic portions to one another avoids breakage due to excess resin in the sharp corners of the blades when fabricated in accordance with prior blade manufacturing processes, as above described.

More particularly, the plastic portion of each blade is made up of one hollow piece whose interior decreases in width in a direction from its inner to its outer end, and the metallic portion has an outer end which fits within and is fastened to the inner end of the plastic portion. Because of its shape, the plastic portion of each blade does not require the use of a bag or other flexible inner mold member, as is required in the molding of blades of this type entirely of plastic, as previously described. Instead, since the plastic portion is widest at its end which interfits with the metallic portion, and decreases in width in a direction between such end and its opposite outer end, the inner mold member may be rigid and the resin may be introduced under pressure into reinforcement contained within a space between the mold members.

To provide a simple and inexpensive means of preventing things and/or objects from lodging inside the hollow plastic portion, and thus possibly upsetting the aerodynamic balance of the fan, a barrier disposed across the interior thereof near the outer end of the metallic portion, is inserted into the open end of the plastic portion prior to interfitting of the metallic portion therewith.

In the preferred and illustrated embodiment of the invention, the interfitting metallic and plastic portions of each blade are secured by fasteners which are manipulated from within their interfitting ends, and the metallic portion is hollow and has sides which are open to permit access to such fasteners. Since the fasteners are manipulated in this manner, their outer ends may be flush with the air foil cross section of the exterior of the plastic portions of the blades.

More particularly, the metallic portions include a pair of elongate sheets whose inner ends are approximately semi-circular and whose outer ends are substantially flat. A ring surrounds and is fixed to the outer ends of the sheets to provide a means of attachment to the fan hub, and the longitudinal edges of the sheets flare from their inner to their outer ends to form the openings in their sides through which access may be had to the fasteners.

In the drawings, wherein like reference characters are used throughout to designate like parts:

FIG. 4 is a longitudinal sectional view of the plastic and metallic portions of the blade of FIG. 2, as seen along broken lines 4—4 thereof;

FIG. 5 is a cross-sectional view of the blade of FIG. 2, as seen along broken lines 5—5 thereof;

FIG. 6 is a cross-sectional view of a mold in which the plastic portion of each blade may be formed; and FIG. 7 is a plan view of the inner member of the mold of FIG. 6, with the righthand end thereof being broken away for purposes of illustration.

Figure 1:
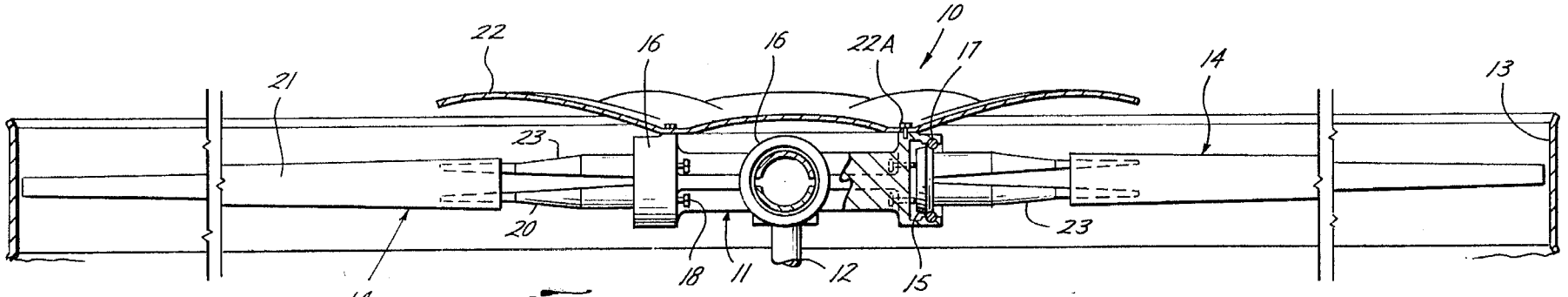
FIG. 1 is a sectional view of an axial flow fan constructed in accordance with the present invention.

Referring now to the details of the above-described drawings, the overall fan 10 shown in FIG. 1 includes a hub 11 rotatable with a shaft 12 disposed centrally within an annular fan ring 13. Fan blades 14 have necks 15 on their inner ends which are coupled to the hub for extension radially outwardly therefrom to dispose their tips close to the inner circumference of the fan ring.

As shown and described in U.S. Pat. No. 2,908,335, each blade neck is held securely within an open-ended housing 16 mounted on the hub by means of split rings 17 which are received within a groove in the housing in position to engage a shoulder on the neck. The shoulder is moved into tight engagement with the split rings by means of jack screws 18 extending through the back side to the housings.

When the jack screws are backed off from the ends of the necks 15, the blades are free to be tilted into positions in which the split rings 17 may be removed from within the housings, at which time the blades may then be moved out of the housings for replacement or repair. Obviously, the blades may be installed by a reversal of this procedure.

In the particular fan illustrated in the drawings, the hub has four housings 16 providing sockets for receiving an equal number of blades spaced 90° apart about the axis of rotation of the shaft 12. However, it will be understood that more or less blades may be used in the fan. Also, of course, other means may be employed for coupling the blades to the hub.

As previously described, each blade 14 includes a metallic portion 20 having neck 15 formed thereon for coupling to the hub 11, and a reinforced plastic portion 21 having its inner end interfitted with and secured to the outer end of metallic portion 20. As shown in FIG. 1, fan 10 also includes a seal disc 22 which is connected to the upper side of the hub by means of bolts 22A, and which has an outer periphery (shown in plan by means of broken lines in FIG. 2) which extends outwardly to approximately the joinder of the metallic and plastic portions of the blades.

As best shown in FIG. 4, and as previously described, the metallic portion 20 of each fan blade includes a pair of sheets 23 each of which has an inner end which is substantially semi-circular in cross section and an outer end which is substantially flat, except for a relatively shallow, downturned edge, for strength purposes. When the substantially semi-circular outer ends of the sheets 23 are disposed opposite one another, the sheets form a hollow body whose outer end is open circular in cross section, and whose inner end is open intermediate the inner ends of the sheets.

The outer end of the metallic portion is surrounded by a metal ring 24 which provides the neck 15 for coupling to a hub housing, as previously described, including an outwardly facing shoulder against which the split rings 17 may engage, as best shown by broken lines in FIG. 4. The sheets 23 of the metallic portion are welded to the ring about their inner ends as well as along the portions of their edges which are received within the ring.

Figure 2:
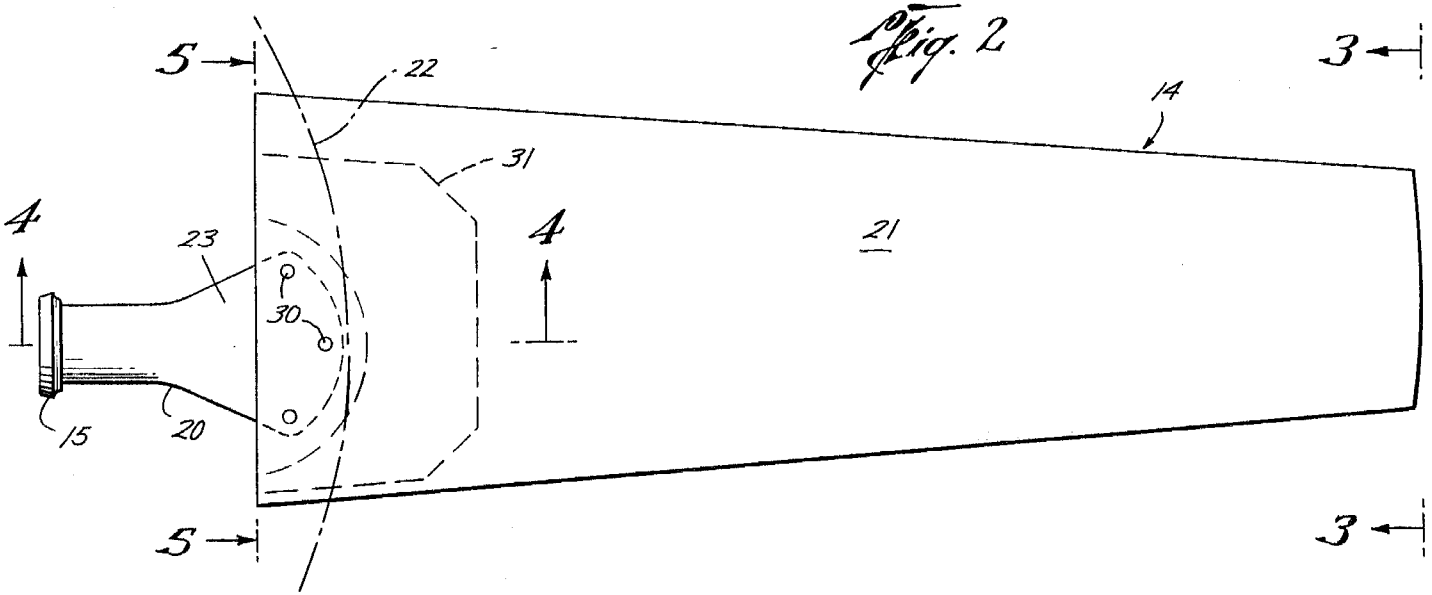
FIG. 2 is a plan view of one of the blades removed from the hub of the fan.

The longitudinal edges of the sheets flare outwardly, as shown in FIG. 2, so that metallic portion 20 is broader at its outer end than at its inner end. Such edges also flare outwardly, as seen from the side (FIG. 4), to form openings or slots 24A into the hollow interior thereof. Sheets of this configuration may be stamped from flat stock in a conventional manner.

The plastic portion 21 of each blade is molded as one piece having an exterior air foil section and a hollow interior which decreases in width in a direction from its inner end to its outer end. Consequently, it is possible to mold the plastic portion 21 between rigid inner and outer mold members 25 and 26. As shown in FIG. 6, the outer mold member 26 is made up of horizontally split upper and lower sections, and the inner mold member is made up of longitudinally split sections 27.

In the molding of plastic portion 21, reinforcement is laid up on the upper face of lower outer mold member 26, the inner mold member 25 is disposed over the reinforcement, which then is laid up over the top side of inner mold member 25, and the upper section of the outer mold member 26 is lowered into place over the reinforcement. At this time, resin may be forced into and through the reinforcement within the space between the inner and outer mold members by the application of pressure. When the reinforcement is fully and evenly saturated with resin, the resin may be caused to set up in order to complete the molding process.

As can be seen from the drawings, the plastic portion 21 of the blade is not only of an air foil shape in cross section, but also twisted somewhat between its inner and outer ends. Since the inner mold member 25 is of considerable length, and of rigid construction, it would be difficult to remove it, upon molding of the blade portion 21, due to the fact that it, like the portion 21, is twisted from its inner to its outer ends. However, forming the inner mold member in longitudinally split sections 27 facilitates its removal from the molded blade portion, in that it permits such sections to be removed sequentially from a position within the blade portion in which there is little or no twist.

Figure 3:
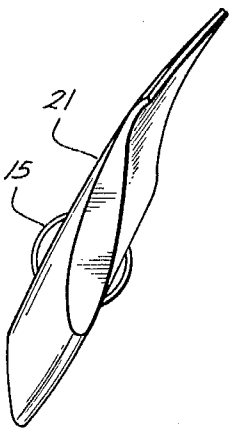
FIG. 3 is an end view of the blade of FIG. 2, as seen along broken lines 3—3 thereof.

That is, as can be seen from FIG. 3, the twist in the air foil section revolves generally around its center line, so that little difficulty is normally experienced in removing the center section 27 of the inner mold member. Thus, it is contemplated that the center section would be removed first, and the two end sections would then be sequentially moved laterally into the space occupied by the center section, and then moved longitudinally out of the molded portion 21. As shown in FIGS. 6 and 7, thin strips 28 may extend through aligned slots in the adjacent sides of the inner mold sections 27 in order to align with one another during preparation for and actual performance of the molding process.

As shown, the substantially flat outer ends of the sheets 23 fit closely within the opposite sides of the inner open end of blade portion 21. Preferably, the inner and outer mold members are formed with flat sides at their inner ends so that the sides of the plastic portion 21 within which the outer end of metallic portion 20 fits will be flush with the substantially flat sides of the sheets 23. As shown in FIG. 2, the outer ends of metallic portion 20 extend within the inner end of plastic portion 21 a distance sufficient to dispose its rectangular open end entirely therein.

The interfitting ends of the metallic and plastic portions are secured to one another by fasteners 30. As shown in FIG. 2, there may be three such fasteners extending in an arc concentric to the outer curved end of the metallic portion 20. These fasteners are manipulatable from within the interfitting ends of the metallic and plastic portions. For this purpose, the fasteners may be bolts whose heads bear against the outer sides of the plates 23, and whose inner ends are secured by nuts which may be made up with the bolts through the outer sides of metallic portion 20. Obviously, the nuts may also be manipulated through the openings to permit the interfitting ends of the metallic and plastic portions to be disconnected from one another.

In order to prevent things and/or objects from becoming lodged within the hollow blade portion 21, a barrier 31 of foamed plastic or other lightweight material is disposed across the hollow interior of the portion 21 near its inner end. More particularly, this barrier is shaped to fit closely within the hollow interior of blade portion 21 at a location just outwardly of the outer end of metallic portion 20. Thus, as shown in broken lines in FIG. 2, the inner end of barrier 31 has a recess for fitting generally concentrically of the outer curved end of metallic portion 20.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. An axial flow fan, comprising a rotatable hub, a seal disc on one side of the hub extending outwardly from the periphery of the hub, a plurality of blades each extending radially from the hub, each blade comprising a metallic portion having a neck which is attached to the hub, and a reinforced plastic portion which has an exterior air foil cross section, and which is made of one hollow piece which decreases in width in a direction from its inner to its outer end, the outer end of the metallic portion fitting a relatively short distance into and being of substantially less width than the inner open end of the plastic portion, and fasteners securing the interfitting ends of the blade portions to one another, the outer periphery of the seal disc extending outwardly to approximately the inner ends of the plastic portion of the blades.

2. A fan of the character defined in claim 1, wherein the outer end of the metallic portion of each blade is hollow and includes relatively flat, spaced-apart sides fitting closely against correspondingly shaped inner walls of the blade portion.

3. A fan of the character defined in claim 1, including a barrier of relatively lightweight material extending across the interior of the plastic portion of each blade near the outer end of the metallic portion.

4. A fan of the character defined in claim 1, wherein the fasteners are manipulated from within the interfitting ends of the metallic and plastic portions of each blade, and the metallic portion has openings therein to permit access to the fasteners.

5. A fan of the character defined in claim 4, wherein the metallic portion of each blade includes a pair of elongate sheets whose inner ends are approximately semi-circular and whose outer ends are substantially flat, a ring surrounds and is fixed to the outer ends of sheets, and the longitudinal edges of the sheets flare from their inner to their outer ends to form said openings.

6. A blade for an axial flow fan, comprising a one-piece, reinforced plastic portion having an exterior air foil cross section and a hollow interior which decreases in width in a direction from its inner end to its outer end, a metallic portion having a neck at its inner end for attachment to the hub of the fan and an outer end which fits a relatively short distance into and is of substantially less width than the inner open end of said plastic portion, and fasteners securing the interfitting ends of such portions to one another.

7. A blade of the character defined in claim 6, including a barrier of relatively lightweight material extending across the interior of the plastic portion near the outer end of the metallic portion.

8. A blade of the character defined in claim 6, wherein the metallic portion is also hollow.

9. A blade of the character defined in claim 8, wherein the fasteners are manipulated from within the interfitting ends of the metallic and plastic portions of each blade, and the metallic portions has openings therein to permit access to the fasteners.

10. A blade of the character defined in claim 9, wherein said metallic portion of each blade includes a pair of elongate sheets whose inner ends are approximately semi-circular and whose outer ends are substantially flat, a ring surrounds and is fixed to the outer ends of sheets, and the longitudinal edges of the sheets flare from their inner to their outer ends to form said openings.

11. A blade of the character defined in claim 6, wherein the outer end of the metallic portion of each blade is hollow and includes relatively flat, spaced-apart sides fitting closely against correspondingly shaped inner walls of the blade portion.

* * * * *